United States Patent [19]

Karra et al.

[11] Patent Number: 4,671,464

[45] Date of Patent: Jun. 9, 1987

[54] METHOD AND APPARATUS FOR ENERGY EFFICIENT COMMINUTION

[75] Inventors: Vijia K. Karra, Greendale; Anthony J. Magerowski, Milwaukee, both of Wis.

[73] Assignee: Rexnord Inc., Brookfield, Wis.

[21] Appl. No.: 830,774

[22] Filed: Feb. 14, 1986

[51] Int. Cl.[4] ..... B02C 23/18

[52] U.S. Cl. ..... 241/21; 241/29; 241/30

[58] Field of Search ..... 241/15, 16, 21, 29, 241/30, 38, 41, 207-216, 286, 290, 62, 202

[56] References Cited

U.S. PATENT DOCUMENTS

| | | | |
|---|---|---|---|
| 1,620,838 | 3/1927 | Seigle et al. . | |
| 2,309,036 | 1/1943 | Bearsley | 241/41 |
| 3,600,477 | 8/1971 | Friedel et al. | 264/3 |
| 4,132,365 | 1/1979 | Verschuur | 241/21 |
| 4,281,800 | 8/1981 | Flavel | 241/24 |
| 4,357,287 | 11/1982 | Schonert | 264/39 |
| 4,359,193 | 11/1982 | Schonert | 241/3 |
| 4,478,373 | 10/1984 | Gieschen | 241/208 |
| 4,500,041 | 2/1985 | Nakaoji et al. | 241/21 X |

OTHER PUBLICATIONS

"Polaris Mine: Production Success in the Rugged Arctic", Mining Engineering, Oct. 1984, pp. 1401-1406.

Suresh P. Babu and Joseph W. Leonard, "Hydrocrushing of Coal", Coal Research Bureau Technical Report No. 103, Apr. 1974.

V. K. Karra, "Crushing Under Water Flush", Engineering & Mining Journal, May, 1982, pp. 103-106.

*Primary Examiner*—Timothy V. Eley

*Attorney, Agent, or Firm*—Lawrence J. Crain

[57] ABSTRACT

A method and apparatus of comminuting ore-like material to produce a disproportionately large volume of flakier product which is easily and more efficiently ground in a mill, wherein the method includes the application of a stream of liquid all around the inlet of a conical crusher, increasing the speed and reducing the throw of the crusher to produce a generally flaky product, crushing the ore in the presence of the liquid and passing the ore and liquid slurry directly to a grinding mill.

13 Claims, 11 Drawing Figures

METHOD AND APPARATUS FOR ENERGY EFFICIENT COMMINUTION

BACKGROUND OF THE INVENTION

The present invention relates to methods and apparatus of comminuting rock, coal or other ore-like materials which reduce the capital and operational costs of that comminution. More specifically, the present invention involves the introduction of a liquid into a conical crusher in a manner which increases the production of the crusher, while simultaneously decreasing the cost of subsequent grinding.

Conventional methods of comminution comprise passing raw ore through a series of crushers, screens, and grinding mills until a suitable size of product is produced. The combination of increased capital and operational costs coupled with falling ore grades has forced mine operators to streamline their operations to achieve a lower cost of production per ton of material.

One suggestion for achieving greater milling efficiency involves the collection of the material to be reduced in size, and compressing it between two non-yielding hard surfaces under sufficiently high compression to result in size reduction as well as briquetting of the particles. Preferably the briquettes contain 30–50% of a final product grade material that would be normally obtained as the product of a following grinding-/delumping mill. The feed-to-product transformation in such a scheme is claimed to save energy consumption in excess of 10% over the same transformation performed with conventional grinding machinery. The mixing of a suitable liquid with the material before such high compression is stated to result in briquettes of lower strength compared to briquettes formed in the absence of liquid.

This method contains several disadvantages: (1) limited capacity of individual comminution devices (in the range of 20 tons/hour), due to their multi-faceted objective, which includes bringing down the top size, producing 30–50% final product grade material, as well as agglomerating the product into briquettes; (2) briquettes require additional expenditure of energy for delumping; and (3) severe wear of the surfaces effecting the compression of the material to be broken down in size. Traditional high production mining operations require several of such high compression devices, and it is expected that there would not be meaningful cost savings, capital and operating, to implement the technique. Thus, any non-briquetting comminution technique which enhances the productivity of existing, already high capacity crushing and grinding machinery at a substantial savings in overall energy consumption, provides a better, economically feasible approach.

It has been known for some time that crushing in the presence of water will decrease dust, material packing in the crusher chamber and the percentage of fines in the crusher product. Another method of reducing the energy required in the comminution process involves the introduction of water into a crusher to form a slurry containing four percent solids. Tests with a jaw crusher indicate that this wet crushing process provides a 74 percent increase in crushing rate for hard coals and a 121 percent increase for softer coals. In addition, power consumption is reduced by as much as 66 percent compared to conventional dry crushing.

The major disadvantage of this basic wet crushing method is that the extremely low percentage of solids in the slurry is not suitable for large scale commercial milling operations. A later analysis of this method using a cone crusher and slurries of 30 to 60 percent solids revealed that the reduction in required crusher horsepower which followed the introduction of water into the crusher would be essentially offset by the additional power required for supplemental pumps and classifiers needed to practice the process.

Thus, there is a continuing need for an economically feasible method of comminution which requires less energy than conventional systems and requires a reduced level of capital and operational resources.

It is therefore a major object of the present invention to provide an improved method of comminution which results in a reduction of power consumption per ton of ore.

It is another object of the present invention to provide a method of comminution which employs a carrier liquid such as water in the crushing process to achieve a commercially viable reduction in capital and operating costs.

It is a further object of the present invention to provide a method of comminution which results in a greater efficiency in both the crushing and final milling steps.

It is a still further object of the present invention to provide an apparatus which may be used to readily convert conventional cone crushers to crushers capable of water flush crushing.

SUMMARY OF THE INVENTION

The comminution apparatus and method of the present invention relates to the use of a fluid such as water in conjunction with a conical crusher so that crusher production is significantly increased and that production comprises a relatively flaky product with a low percentage of fines. This product may be more easily ground in a ball or pebble mill with a significant savings in milling costs.

More specifically, the method and apparatus of the present invention involves the addition of liquid to the crusher so that the entire crushing chamber is continually wetted. One advantage of introducing water into the crushing chamber is that the fine material produced by crushing is flushed from the crushing chamber, allowing increased production. The crusher is adjusted by decreasing the throw and increasing the gyrational speed of the head. A combination of the above-identified adjustments and the introduction of water enables a conventional cone crusher to produce a significantly higher volume of flake-shaped crusher material with less fines.

The reduction in fines allows the crushed material to be processed directly in a grinding mill rather than to a classifier followed by the mill. The elongate shape of this flakier material, with its inherent ease of breakage compared to cuboidal particles, significantly enhances the comminution efficiency of a grinding mill.

Energy in the subsequent milling step is saved by feeding a grinding mill with a feed (the product of the liquid flushed crusher) which behaves in the mill as if were a substantially finer feed, because of its unique shape characteristics. Thus, the present method can be characterized as precrushing before milling rather than pregrinding before milling as envisaged in the prior art.

DESCRIPTION OF THE DRAWINGS

The novel features and advantages of the present invention will become more apparent upon a review of the drawings in which.

DESCRIPTION OF THE PREFERRED EMBODIMENT

Figure 1:
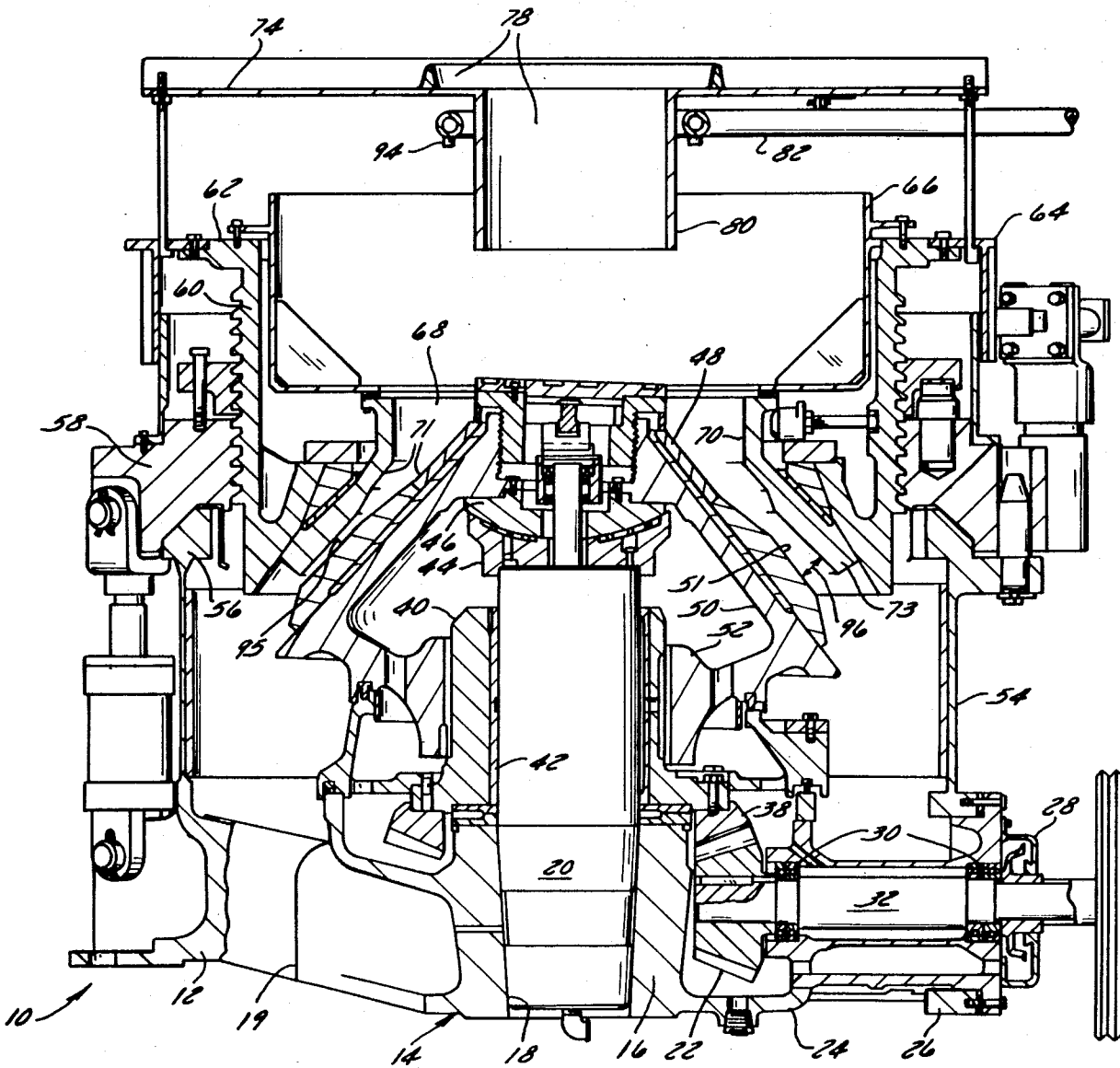
FIG. 1 depicts a sectional view of a conical crusher of the type employed in the present process.

Referring now to the drawings, wherein like reference numerals indicate like elements, FIG. 1, for purposes of example, depicts a simplified version of the cone crusher disclosed in U.S. Pat. No. 4,478,373 to Gieschen which has been modified to comport with the process of the present invention. It should be understood that the present invention is not restricted to this particular cone crusher, but may be practiced on any of several conventional conical crushers.

The crusher 10 is comprised of a frame 12 having a central hub 14 formed from a cast steel member having a thick annular wall 16 forming an upwardly diverging vertical bore 18 adapted to receive a cylindrical support shaft 20. A plurality of discharge ports 19 are provided for the removal of crushed material. Frame 12 extends outwardly from hub 14 to enclose drive pinion 22. Supported by housing 24 and an outer seat 26 is a countershaft box 28 which, through bearings 30, is adapted to house countershaft 32 with pinion 22.

Countershaft 32 is rotated by a suitable exterior pulley 34, shown channeled at 36 to receive V-belt or other suitable driving means such as a motor (not shown). Pinion 22 engages annular gear 38 which is bolted to an eccentric 40 rotatable about shaft 20 via annular bushing 42.

Cylindrical support shaft 20 extends above eccentric 40 and supports socket bearing or spherical seat 44. Seated against socket bearing 44 is spherical upper bearing 46 which supports the entire head assembly 48. Head assembly 48 is comprised of head member 50, having a conical configuration about which is positioned a mantle 51. Extending inwardly of head member 50, a follower 52 is disposed around and engaging the outer surface of eccentric 40.

A tubular mainframe shell 54 projects upwardly from countershaft box 28. The upper portion of shell 54 terminates in an annular ring having a wedge section known as adjustment ring seat 56. Seat 56 normally supports an annularly shaped adjustment ring 58 positioned directly above seat 56.

The inner annular surface of adjusting ring 58 is helically threaded to receive a complimentary threaded outer annular surface of the crusher bowl 60. Rotation of bowl 60 thus adjusts the relative position thereof with respect to ring 58 and changes the setting of the crushing members. The upper extension of bowl 60 terminates in a horizontal flange 62 to which is bolted a downwardly extending annular adjustment cap ring 64.

Bolted at various spaced positions along the top surface of flange 62 is material feed hopper 66. Hopper 66 extends into the opening enclosed by bowl 60 and is provided with a center opening 68 for the entry of material into the crusher.

Bowl 60 is further provided with an upper liner 70 which provides the crushing surface against which head mantle 51 forces incoming material in a gyrating action. Crushing cavity or gap 71 is located between mantle 51 and liner 70. The importance of gap 71 will be discussed in greater detail below.

A plurality of vertically projecting support shafts 72 are fixed to the horizontal flange 62. These support shafts are constructed and arranged to secure and support feed platform 74 above hopper 66. Feed platform 74 is provided with an annular particle barrier 76 which encircles feed inlet 78. Feed inlet 78 includes vertically depending chute 80, which in the preferred embodiment extends into the mouth of hopper 66.

The operation of crusher 10 involves the eccentric gyration of head 50 about vertical support 20 and within the confines of bowl liner 70. This gyration comprises a cycle during which head 50 alternates between a closed or crushing side, shown at 95 and an open side at 96. Incoming material is crushed until it is small enough to pass through the open side. Since the head 50 is continually gyrating, some material is always being crushed or passing through the open side through discharge ports 19.

Crusher 10 is often referred to as having a designated setting, or the distance between liner 70 and mantle 51 when head 50 is closed as at 95. The displacement of head 50 between the widest opening at 96 and the narrowest opening at 95 is commonly referred to as the "crusher head throw", or simply as the "throw". Throw is dependent on crusher size, and is altered by changing the eccentricity of the eccentric 40.

Figure 2:
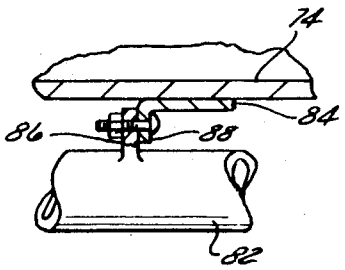
FIG. 2 is an enlarged view in partial section of mounting means used with the water flush apparatus depicted in FIG. 1.
Figure 4:
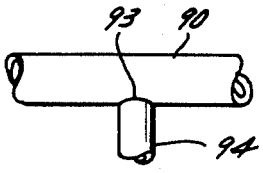
FIG. 4 is an enlarged side view of the water flush apparatus depicted in FIG. 3.
Figure 3:
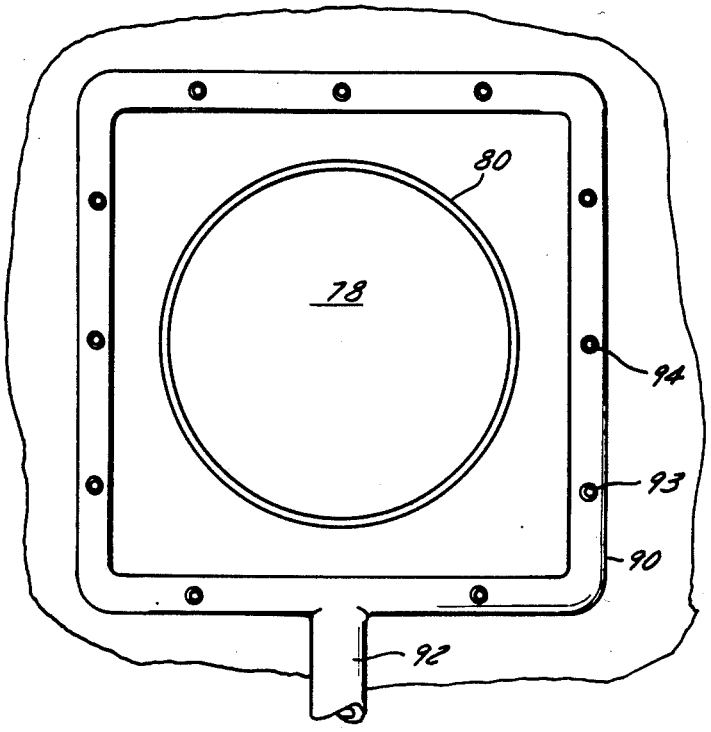
FIG. 3 is a plan view of the underside of the water flush apparatus depicted in FIG. 1.

Referring now to FIGS. 2–4, a water flush spray apparatus 82 is secured to the underside of feed platform 74 by fastening means comprising at least one 'L' bracket 84, corresponding eyelet 86 and bolt 88. Spray apparatus 82 may take various forms, but in the present invention is comprised of a loop 90 fabricated of pipe, which in the preferred embodiment has a diameter of approximately four to six inches. In the preferred embodiment, loop 90 is designed to circumscribe chute 80, and is welded to an inlet stem 92 of similar diameter connected to a source of medium such as water or other pressurized liquid, or a compressed gas, such as air. In the present invention, the crushing medium, in this case water, is pressurized by forcing it through a plurality of relatively small openings 93.

A plurality of nozzles 94, essentially segments of one inch pipe, are fixed into holes 93 preferrably by welding. Nozzles 94 are designed to direct the flow of liquid into gap 71 around the entire circumference of head assembly 48 so that all areas of liner 70 will be flushed. In the present invention, these nozzles are pointed in a vertically depending direction, but other configurations may be used. When a spray apparatus 20 having the dimensions of the present invention is employed, water flow rate can be adjusted to create slurries ranging from 30–85% solids (by weight) within the cone crusher cavity.

When crusher 10 is in operation, the spray from nozzles 94 enters the crushing chamber through central opening 68, where it mixes with incoming material prior to crushing. It has been observed that increases in crusher productivity are most pronounced when the water continually impacts the entire rim of gap 71.

The Present Method

It has been found that when a "water flush" crusher is used in conjunction with a ball or rod mill for further comminution, the resulting shape of the material exiting the crusher improves the efficiency of the total crusher/mill system by being more easily ground in the mill. More specifically, a greater amount of flakier crusher product has been found to pass as feed to the grinding mill. The flakiness of a material flow is determined by the percentage of particles which are generally broad and flat, or plane-shaped, as opposed to cuboidal, and can be quantified using standard flakiness testing devices, such as prescribed in the "Operating Procedure G-11 for Measurement of Flakiness Index of Granules", published by Central Laboratory of Highways and Bridges, Dunod, Paris, France 1971.

Thus, it became an additional goal of the present invention to increase the flakiness of the crushed product. A cone crusher set at conventional head throw and gyrational speed produces a product having approximately fifteen percent flakes. It was found that when throw is reduced and speed increased in a conventional (dry) cone crusher, the percent flakiness decreases from the normal fifteen percent to about ten percent. This decrease results from the rounding of particles larger than the setting with a consequent increase in the amount of fines produced. A reduction in throw and corresponding increase in eccentric speed will in turn significantly decrease the production of the conventional crusher.

Furthermore, in situations where the crusher bowl is set at the lowest setting to obtain the smallest possible product, the fines generated in the cavity enhance the buildup of a cake-like material which causes the crusher ring to "bounce," preventing normal operation, decreasing production and significantly shortening the usable life of the crusher.

However, it was found that when water was added to a crusher having a reduced throw and increased speed via the spray apparatus described above, the percentage of flaky material increased to about 30% of the total crusher product. Apparently, the water flushes the fines from the crushing chamber to prevent formation of any cake-like material in the cavity.

Although the preferred embodiment is primarily concerned with the use of water as the media to increase production, alternative fluids may also be employed. For example, pressurized gas such as air may be directed into crushing cavity 71 to assist in the removal of fines and in the movement of crushed material. Since air is not naturally subject to gravity as is water, a vacuum may be created adjacent to the discharge port 19 by conventional means such as a vacuum pump to draw the air through the crusher along with the crushed product.

It was also found that the flakier product of the present process is more easily ground in pebble or ball mills. The most probable reason for this greater grinding efficiency is that flakier particles are easier to fracture by forces exerted perpendicularly to their flattened dimension than are the cuboidal particles produced by conventional "dry" crushing.

In quantitative terms, when water is introduced into a crusher wherein the head throw has been reduced on the order of 10 to 50% of normal throw, and the head speed has been increased on the order of 110 to 200% of normal speed, crusher production increases on the order of 150 to 350% of an identical conventional dry crusher at the same bowl setting but working under normal throw and speed parameters.

Figure 5:
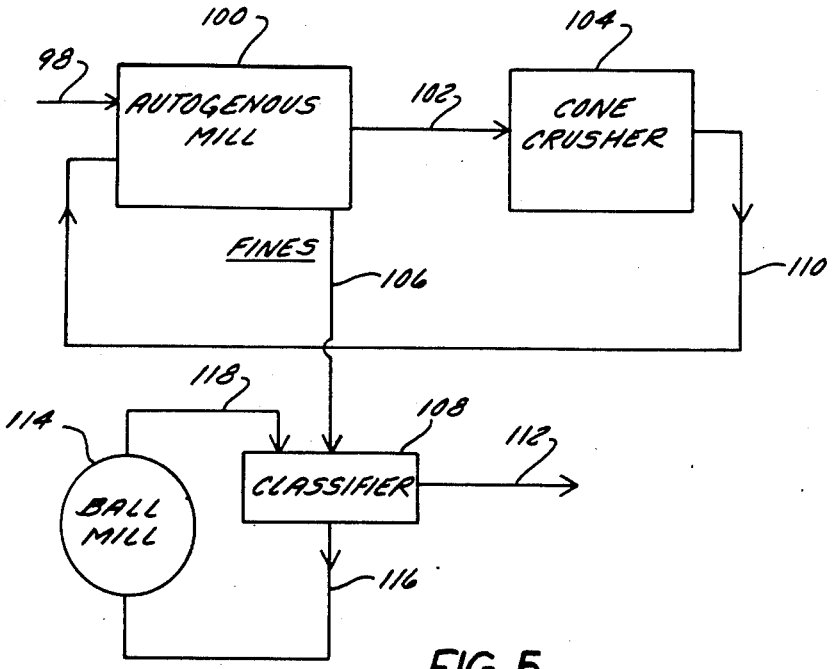
FIG. 5 PRIOR ART
FIG. 5 is a flow diagram of a conventional method of comminution.

One implication of these findings is that the capital and operational costs of conventional comminution processes can be significantly reduced by the present process. Referring now to FIG. 5, wherein a conventional closed circuit comminution process is depicted, new feed 98 enters an autogenous or semiautogenous mill 100. The autogenous mill creates a coarse product which is passed by transport means 102 to a conventional cone crusher 104, and a fine product which is passed by transport means 106 to a classifier 108. Transport means could be either a conveyor or slurry pipeline depending on the water content of the material to be transported. Crusher 104 is referred to as being in closed circuit with mill 100, since the product of the crusher 104 is sent back to mill 100 via transport means 110. Classifier 108 splits the incoming materials via transport means 106 and 108 into product grade fines that are transported by means 112 and a coarser material that is cycled to a ball or pebble mill 114 via transport means 116. Discharge of mill 114 goes to classifier 108 via transport means 118.

Figure 6:
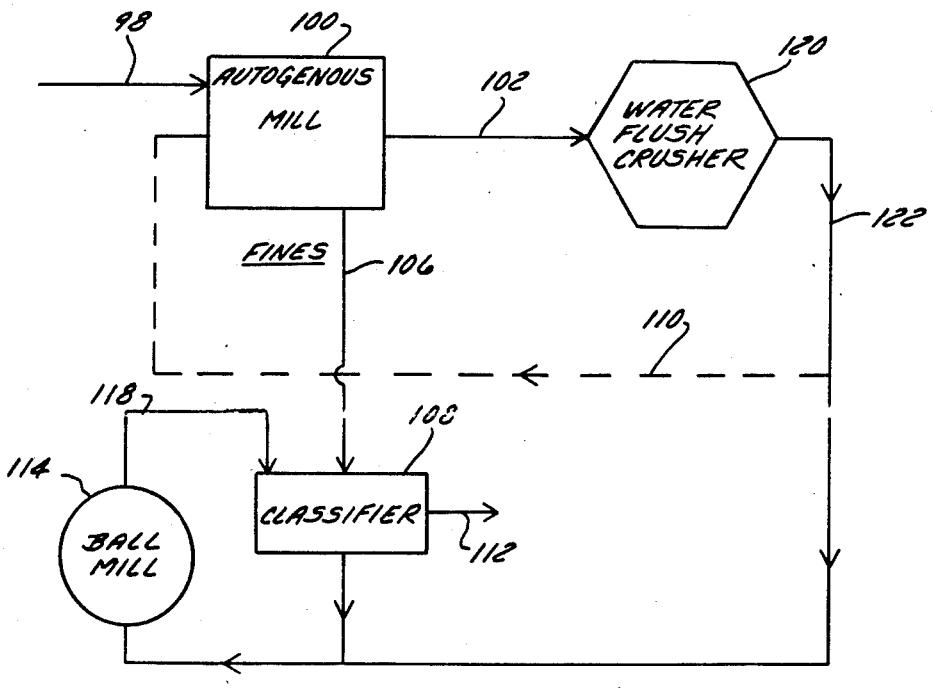
FIG. 6 is a flow diagram of the present method of comminution.

FIG. 6 illustrates how the present process can simplify and improve upon the prior art shown in FIG. 5. A cone crusher 120 fitted with the water flush apparatus 82 is substituted for conventional crusher 104. The increase in flakes content and decrease in fines content associated with water flush crushing allows the crusher product to be routed directly to ball mill 114 via transport means 122. If there is a productivity constraint on the ball mill, a partial or full diversion via loop 110 may be employed as an option. The rate at which water is added to the crusher is generally designed to eliminate the addition of supplemental water to ball mill 114. It is very important to eliminate the escape of steel balls from semiautogenous mills by means of magnetic separators, so that the feed to crusher 120 is devoid of balls. The present flowsheet is likely to increase the overall capacity of the prior art flowsheet in excess of 20% which in turn lowers the total cost per ton of product produced at 112. In addition, the present process tends to produce less slimes than the prior art process.

Figure 7:
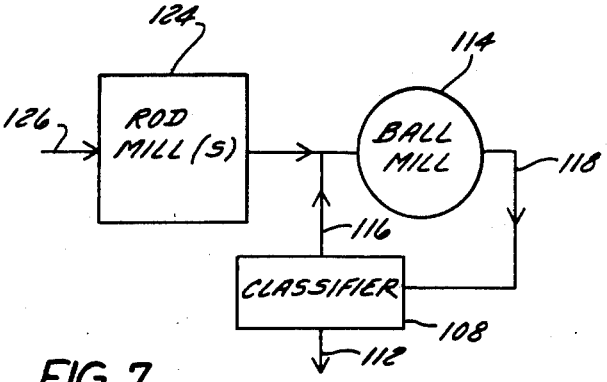
FIG. 7 PRIOR ART
FIG. 7 is a flow diagram of another conventional method of comminution.

Referring now to FIG. 7, a comminution process is depicted wherein a rod mill 124 has been employed to receive the feed 126 from a tertiary crusher. Although rod mills are commonly employed as feed preparation units for ball/pebble mills, adequate alternatives to their use have long been sought because of their high capital and operating costs.

Figure 8:
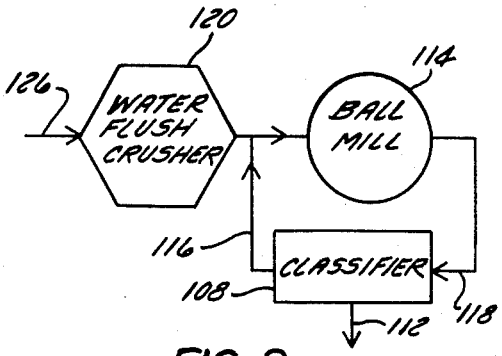
FIG. 8 is a flow diagram depicting an alternate embodiment of the present invention which is an improvement to the method depicted in FIG. 7.

FIG. 8 illustrates the present process in which a conical crusher 120 fitted with the water flush apparatus 82 produces a product that behaves quite comparably to that produced by rod mill 124 as far as its grinding behavior in the ball mill 114 is concerned. This is because the water flush process can be implemented on a conical crusher adjusted to the lowest possible bowl setting to produce a finer product without fear of engendering unwanted crusher "bounce." In addition, the flaky product from the crusher is more easily ground in mill 114. It is well established that conical crushers are less expensive initially and are far easier to maintain than are equivalent capacity rod mills. Thus, a significantly lower total cost/ton of product produced at 112 is expected. Slimes content in stream 112 is expected to be lower than the prior art process.

Figure 9:
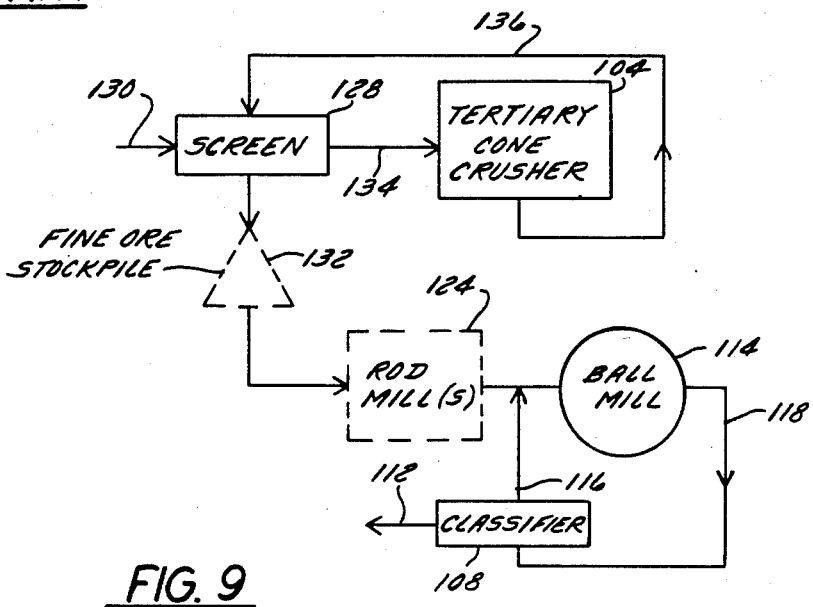
FIG. 9 PRIOR ART
FIG. 9 is a flow diagram of yet another conventional method of comminution.

Referring now to FIG. 9, a conventional comminution process is depicted in which a screen 128 separates the feed 130 from a secondary crusher into fines which are stock piled at 132 and coarse material which is passed through transport means 134 to a conventional tertiary cone crusher 104 until the material is fine enough to stockpile at 132. Depending on the top size of material on the stockpile 132, a rod mill 124 plus a standard or large diameter ball mill 114 may be employed. Typically, 0.75 inch feeds need the rod and ball mill arrangement, and 0.5 inch material can be processed in a single-stage ball mill. The material is then passed through a circuit comprising a ball mill 114, transport means 118, classifier 108 and transport means 116 to achieve the desired degree of comminution.

Figure 10:
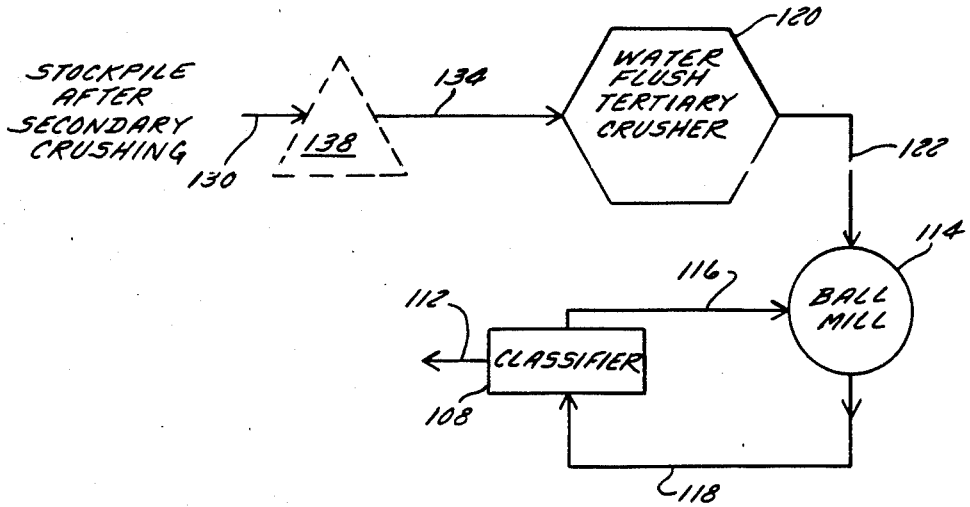
FIG. 10 is a flow diagram depicting an alternate embodiment of the present invention which is an improvement upon the method depicted in FIG. 9.

In contrast, FIG. 10 illustrates how the present process and apparatus may be used to simplify the comminution system of FIG. 9. By replacing the tertiary cone crusher 104 with a water flush cone crusher 120 and a direct slurry line 122 to ball mill 114, the use of screen 128, transport means 134 and 136 and optional rod mill 124 are all eliminated at a significant savings in total cost/ton of product produced at 112.

The existence of the direct slurry line 122 between crusher 120 and ball mill 114 necessitates the relocation of stockpile 132 to 138, after secondary crushing is completed and just before the material enters the water flush crusher 120. Crusher 120 should be located as close to mill 114 as possible, in order to eliminate unnecessary pumping of slurry through 122, for example, by direct gravity feed of the crusher discharge into the inlet of mill 114. The elimination of slurry pumping saves considerable amounts of energy. From stockpile 138 the material is transferred via transport means 134 to the water flush crusher 120. From that point, the process is identical to that described in FIG. 6.

Figure 11:
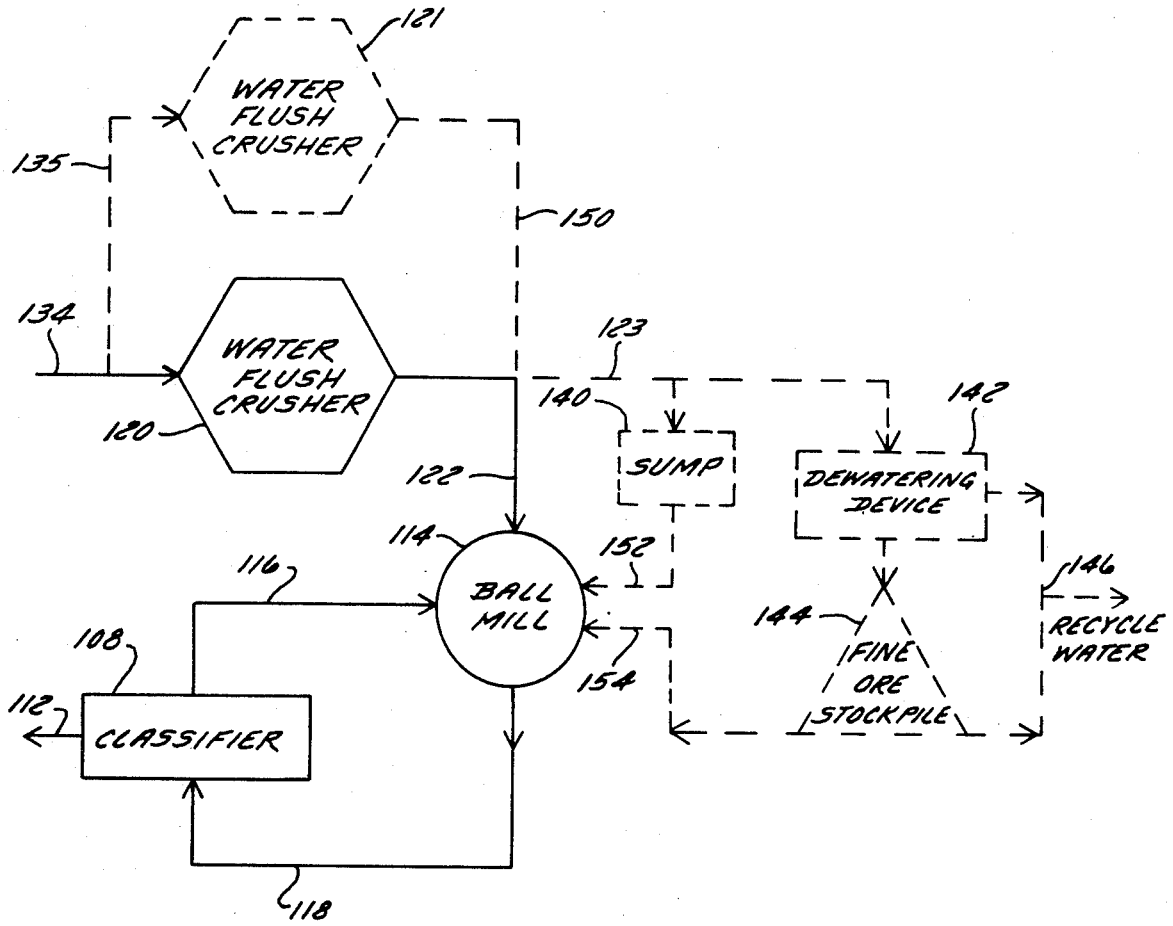
FIG. 11 is a flow diagram depicting an alternate embodiment of the method of FIG. 10.

Referring now to FIG. 11, in certain process applications the availability of water flush crusher 120 and ball mill 114 may not be totally compatible. In cases where the availability of crusher 120 is lower than that of ball mill 114, the size of the crusher 120 is selected so as to provide a suitably higher nominal capacity than the mill 114. The discharge from crusher 120 may be diverted via transport means 123 to a sump or holding tank 140 for temporary storage. The ball mill 114 then receives slurry from tank 140 through transport means 152 at a desired flow rate.

As an alternative, if storage in sump 140 is undesirable due to the settling out of particles in the slurry, instead, the outflow of crusher 120 is conveyed via transport means 123 to dewatering device 142, which may comprise a screen or similar device. Dewatering device 142 separates the slurry into a fine ore stockpile 144 and a source of recycle water 146, which may then be conveyed via a transport means (not shown) to crusher 120 or other process application. Stockpile 144 may be provided with additional drainage capability. Transport means 154 conveys fine ore as needed from stockpile 144 to ball mill 114.

Instead of choosing a crusher 120 of higher nominal capacity than that of mill 114, as described in the above paragraph, crusher 120 may be maintained at a size that matches the nominal capacity of the mill 114, and provided with a second, but identical water flush crusher 121. Crusher 121 receives material via transport means 135 and produces a crushed slurry, which is conveyed via transport means 150 to ball mill 114, sump 140 or dewatering device 142. When crusher 120 is undergoing maintenance, feed material can be diverted to crusher 121 and vice versa. In this manner, a continuous flow of feed to mill 114 can be maintained as long as the mill is available for production. When mill 114 is undergoing maintenance, feed 134 to crushers 120 and 121 may be stopped. If feed 134 is not stopped, the discharge from crusher 120 and/or 121 may be sent via transport means 123 to either sump 140 or to stockpile 144 (the latter via dewatering device 142). The additional capital cost of crusher 121 is more than offset by savings in reduced downtime.

EXAMPLE 1

The production of a cone crusher was first tested using the conventional dry format, then applying a water flush apparatus with a four inch pipe and 12 nozzles. The data reveal that although wet crushing requires more horsepower, the tremendous increase in production results in a more than 50% reduction in required power per ton produced.

| | Dry Crushing | Wet Crushing |
|---|---|---|
| Setting | ⅛" | ⅛" |
| Production in short tons/hour (STPH) | 17.1 | 49.6 |
| Operational horsepower | 87.4 | 108.9 |
| Horsepower/tons produced | 5.1 | 2.2 |

EXAMPLE 2

A second test was conducted in which a closed circuit dry tertiary cone crusher was followed by an open circuit ball mill. The results were compared with those obtained when the circuit arrangement was changed to a water flush tertiary cone crusher in open circuit followed by the same open circuit ball mill arrangement. The data reveals that a dry crusher with a wider setting is more efficient than a water flush crusher with a narrower setting. Thus, in comparison with Example 1, the wider the setting, the greater the production of a dry crusher. Unfortunately, this greater production takes the form of mostly cuboidal particles which require more energy to mill. However, due to the increased flakiness of the water flush product, there is a significant reduction in required horse/ton produced in the ball mill. Again, an approximate 50% reduction of overall power required is achieved.

| | Dry Crushing | Wet Crushing |
|---|---|---|
| Crusher | | |
| Setting | 5/16" | ⅛" |
| Operational horsepower | 121 | 129 |
| Product tonnage (STPH) | 69.20 | 51.5 |

-continued

| | Dry Crushing | Wet Crushing |
|---|---|---|
| Horsepower per short ton produced | 1.75 | 2.50 |
| Ball Mill | | |
| Operational Horsepower | 4.43 | 3.09 |
| Product Tonnage (STPH) | 0.19 | 0.30 |
| Horsepower per short ton produced | 23.58 | 10.30 |
| Total horsepower per short ton produced | 25.33 | 12.80 |

Thus, the present process and apparatus discloses a means by which the comminution of ore can be accomplished with a significant recution in capital and energy costs.

While particular embodiments of the water flush process and apparatus have been shown and described, it will be obvious to persons skilled in the art that changes and modifications might be made without departing from the invention in its broader aspects.

What is claimed is:

1. A method of crushing minerals by means of a cone crusher having a specified maximum head diameter and comprising a material inlet, a conical head of corresponding maximum head diameter, an annular inner bowl liner against which an annular outer mantle on said head crushes incoming material in a gyrating cycle, said bowl liner and mantle having a circumferential gap or cavity therebetween, said crusher having specified head throw and gyrating speed characteristics, said method comprising:

providing a source of crushable, particulate material;

directing a flow of liquid into said gap between said bowl liner and said mantle so that said bowl liner and mantle bounding said gap are continually moistened and said liquid is mixed with said material to form a slurry in said crusher cavity;

whereby crushing said slurry in said crusher creates a significant proportion of flaky shaped particles in the crushed material.

2. The method defined in claim 1 further comprising introducing sufficient liquid into said gap to create a slurry on the order of from 30 to 85% solids by weight.

3. The method defined in claim 1 further comprising reducing said throw of said head from said specified setting.

4. The method defined in claim 3 comprising reducing said throw of said head on the order of 10 to 50 percent of said specified throw.

5. The method defined in claim 3 further comprising increasing the gyrating speed of said head from said specified setting.

6. The method defined in claim 5 comprising increasing said speed on the order of 110 to 200 percent of said specified speed.

7. The method defined in claim 1 wherein said liquid is water.

8. A process of achieving energy efficient comminution of materials comprising:

providing a source of particulate comminutable mineral material;

passing said material through preliminary reduction means to reduce the size of said particles;

providing at least one conical crusher having a bowl liner surrounding a mantle on a conical head rotating about an eccentric in a gyratory fashion at a predetermined eccentric throw and speed; and said mantle and bowl liners being adjusted to have a minimum permissible gap therebetween;

introducing a flow of liquid through said crusher so that said liquid enters the crusher through said gap;

introducing said comminutable material to said crusher so that said material mixes with said liquid;

passing said mixture of material and liquid through said gap of said crusher to alter the size and shape of said particles, and passing said mixture from said crusher directly to a grinding mill.

9. The process defined in claim 8 wherein said liquid is water.

10. The process defined in claim 8 comprising passing said material through a semi-autogenous grinding mill as said preliminary reduction means.

11. The method defined in claim 8 further comprising passing the mixture to a holding means before passing said mixture to said grinding mill.

12. The method defined in claim 11 comprising passing said mixture to a holding tank as said holding means.

13. The method defined in claim 11 comprising passing said mixture through a dewatering device and then to a stockpile as said holding means.

* * * * *